US006417491B1

(12) United States Patent
Taniuchi

(10) Patent No.: US 6,417,491 B1
(45) Date of Patent: Jul. 9, 2002

(54) SHIELD PANEL AND HELMET

(75) Inventor: Fujio Taniuchi, Saitama (JP)

(73) Assignee: Shoei Co., Ltd., Tokyo (JP)

( * ) Notice: Subject to any disclaimer, the term of this patent is extended or adjusted under 35 U.S.C. 154(b) by 0 days.

(21) Appl. No.: 09/716,522

(22) Filed: Nov. 20, 2000

(30) Foreign Application Priority Data

Jan. 25, 2000 (JP) ..... 12-15994

(51) Int. Cl.[7] ..... H05B 1/00; H05B 3/00; H05B 11/00

(52) U.S. Cl. ..... 219/211; 219/528; 2/424

(58) Field of Search ..... 219/211, 522, 219/203, 548, 543, 528; 2/424, 9, 435, 434; 427/10; 428/469; 52/171.2

(56) References Cited

U.S. PATENT DOCUMENTS 2,689,803 A * 9/1954 Ackerman ..... 427/10
2,724,658 A * 11/1955 Lytle et al. ..... 427/10
4,536,645 A * 8/1985 Mio et al. ..... 219/543
4,584,721 A 4/1986 Yamamoto
4,682,007 A 7/1987 Hollander
4,725,710 A * 2/1988 Ramus et al. ..... 219/203
4,786,784 A * 11/1988 Nikodem et al. ..... 219/543
4,952,783 A * 8/1990 Auderheide et al. ..... 219/528
5,351,339 A 10/1994 Reuber et al.
5,500,953 A 3/1996 Reuber et al.
5,671,483 A * 9/1997 Reuber ..... 2/424
5,694,650 A 12/1997 Hong
5,750,267 A * 5/1998 Takase et al. ..... 428/469
5,824,994 A * 10/1998 Noda et al. ..... 219/203
5,845,342 A * 12/1998 Park ..... 2/424
6,194,692 B1 * 2/2001 Oberle ..... 219/543

FOREIGN PATENT DOCUMENTS

JP 404289685 * 10/1992 ..... H05B/3/20

OTHER PUBLICATIONS

US 5,471,483, 11/1995, Sperbeck (withdrawn)*

* cited by examiner

*Primary Examiner*—Teresa Walberg
*Assistant Examiner*—Leonid M Fastovsky
(74) *Attorney, Agent, or Firm*—Jones, Day, Reavis & Pogue

(57) ABSTRACT

Electrodes for a transparent electrically conductive film provided on a transparent panel of a shield panel have metal foils. The metal foils extend along the transparent electrically conductive film while electrically connected to the transparent electrically conductive film. Therefore, a resistance of each of the electrodes is low and potential drop is less prone to be caused in the electrodes. Thus, a voltage applied between the electrodes is effectively applied to the transparent electrically conductive film, and even if a power source voltage is not high, the transparent panel is effectively heated, and a defogging effect is high. As a result, it is possible to provide a shield panel having high defogging effect and less expensive manufacturing cost, and to provide a helmet having such a shield panel.

21 Claims, 6 Drawing Sheets

SHIELD PANEL AND HELMET

BACKGROUND OF THE INVENTION

1. Field of the Invention

The present invention relates to a shield panel having defogging function using electric heating, and the invention also relates to a helmet having such a shield panel.

2. Description of the Related Art

A helmet that a driver or a passenger of an autobicycle, an airplane, a snowmobile or the like wears is provided with a shield panel which is also called a visor for preventing wind, a flying object or the like from hitting his or her face. When the autobicycle or the like runs at high speed, especially in a cold district, however, since the shield panel is air-cooled, water vapor in exhalation of the wearer impinges on the cold shield panel to cause condensation and freezing thereon, which impairs wearer's visibility. Thereupon, in order to prevent condensation or freezing to secure the wearer's visibility, there is conceived a shield panel having defogging function using electric heating.

A conventional shield panel has a transparent panel provided with a transparent electrically conductive film having uniform thickness, and the transparent panel is provided at its upper and lower end portions with a pair of electrodes extending on the transparent electrically conductive film. The transparent electrically conductive film is a thin film made of indium tin oxide (ITO), gold or the like. Each of the electrodes is formed of conductive paint or the like applied by screen printing. The electrode is provided at its portion with a terminal, and the electrode is connected to a power source of the autobicycle or the like through the terminal, conductive wire and the like. When a voltage is applied to the transparent electrically conductive film and a current flows therethrough, the transparent electrically conductive film heats and the transparent panel is heated by the transparent electrically conductive film (e.g., Japanese Utility Model Publication No. H2-7843).

However, the conductive paint comprises insulative high polymer resin-based paint into which metal particles or metal fibers such as silver are mixed, and it is not possible to bring the metal particles into sufficient contact with each other or the metal fibers into sufficient contact with each other. Therefore, the resistance of the conductive paint cannot be sufficiently lowered. If mixing ratio of metal is increased, the resistance of the conductive paint can be lowered. However, it becomes difficult to apply the conductive paint to the transparent electrically conductive film, adhesion of the conductive paint toward the transparent electrically conductive film is also lowered, and this is not practical.

Therefore, in the conventional shield panel, the resistance of the electrode is high, and if the terminal for the electrode and an end portion of the electrode are separated from each other, potential drop is caused in the electrode, and a voltage applied between the pair of electrodes is not effectively applied to the transparent electrically conductive film of the transparent panel. A voltage of a power source of an autobicycle is as low as 12V, but a voltage applied to the transparent electrically conductive film is further lower, the transparent panel is not effectively heated by the transparent electrically conductive film, and the defogging effect of the conventional shield panel is not always effective. Although it is possible to increase a voltage obtained from the power source, since there is a risk of an electric shock accident is high in view of the usage pattern, it is not preferable.

In the conventional shield panel, the conductive paint is applied by screen printing to form the electrode. Since one time screen printing can only apply the paint of about 25 $\mu$m thickness, in order to form a thick electrode to lower the resistance of the electrode, it is necessary to repeat the application many times. Further, in the case of screen painting, it is easy to apply the paint on a flat surface, but it is not easy to apply the paint on a curved surface. For these reasons, in the conventional shield panel, it is not possible to easily form the electrode on the transparent electrically conductive film of the transparent panel, and manufacturing cost is high.

Further, a heating value of the transparent electrically conductive film is inversely proportional to a resistance of the transparent electrically conductive film if a voltage applied to the transparent electrically conductive film is constant. On the other hand, in order to secure the wearer's visibility, a width of the transparent panel is generally set such that the width at a central portion in the lateral direction is wider than that at both end portions in the lateral direction. Therefore, a distance between the pair of electrodes provided at upper and lower end portions of the transparent panel is also wider at the central portion than at the both end portions. Since the thickness of the transparent electrically conductive film is uniform, the resistance of the transparent electrically conductive film at the central portion is higher than that at the both end portions. The heating value of the transparent electrically conductive film at the central portion is smaller than that of the both end portions.

However, the central portion in the lateral direction of the shield panel is air-cooled strongly by running of the autobicycle or the like, but the both end portions in the lateral direction are air-cooled weakly as compared with the central portion, and exhalation of the wearer impinges mainly on the central portion in the lateral direction of the transparent panel. As a result, water vapor in exhalation of the wearer is prone to generate the condensation or freezing on the shield panel, and with this reason also, the defogging effect of the conventional shield panel is not always effective.

SUMMARY OF THE INVENTION

It is an object of the present invention to provide a shield panel having an effective defogging effect, and to provide a helmet having such a shield panel.

In a shield panel according to the present invention, a pair of electrodes for a transparent electrically conductive film provided on a transparent panel have metal foils. Each of the metal foils is a homogeneous continuous phase made of metal only and thus, the resistance is low. Further, the metal foils extend along the transparent electrically conductive film while electrically connected to the transparent electrically conductive film. For these reasons, even if a terminal for the electrode and an end portion of the electrode are separated from each other, the resistance of the electrode is low, and potential drop is not caused almost at all in the electrode. As a result, since a voltage applied between the pair of electrodes is effectively applied to the transparent electrically conductive film of the transparent panel, even if a power source voltage is not high, the transparent panel is effectively heated, and a defogging effect is effective. Further, since the terminals for the electrodes need not be located at central portions of the electrodes, a degree of freedom in design is high.

In a preferred shield panel according to the present invention, the metal foil is adhered to the transparent electrically conductive film through a conductive adhesive layer. Therefore, even if the transparent electrically conductive film of the transparent panel is three-dimensional curved surface, it is possible to easily mount the electrode to the transparent electrically conductive film, and thus the manufacturing cost is low. Further, a difference in thermal expansion between the metal foil and the transparent electrically conductive film or the transparent panel is reduced by the conductive adhesive layer, the electrodes are less prone to be peeled off from the transparent electrically conductive film, and thus the reliability is high.

In a preferred shield panel according to the present invention, a ratio of the thickness of the transparent electrically conductive film at the central portion in the lateral direction of the transparent panel to the thickness at the both end portions is 1.1 or greater. Therefore, if a ratio of a distance between the pair of electrodes at the central portion to the distance at the both end portions is about 1.1, the resistance of the transparent electrically conductive film at the central portion is equal to or smaller than the resistance at the both end portions, and the transparent electrically conductive film at the central portion heats to a degree equal to or higher than that at the both end portions. Even if the above ratio of distance exceeds 1.1, the heating value of the transparent electrically conductive film at the central portion is secured. Therefore, though the central portion of the transparent panel is air-cooled stronger than the both end portions and the exhalation of the wearer impinges on the central portion when the shield panel is used, a defogging effect is effective. However, if the ratio of the thickness is smaller than 1.1, the heating value of the transparent electrically conductive film at the central portion is not secured.

In a preferred shield panel according to the present invention, the ratio of the thickness of the transparent electrically conductive film at the central portion in the lateral direction of the transparent panel to the thickness at the both end portions is equal to or greater than the ratio of a distance between the pair of electrodes at the central portion to the distance at the both end portions. Therefore, even if the width of the transparent panel is wider at the central portion than at the both end portions to secure the wearer's visibility, the resistance of the transparent electrically conductive film at the central portion is equal to or smaller than that at the both end portions. As a result, potential drop is not caused almost at all in the electrode, and even if the voltage between the pair of electrodes is substantially equal in the central portion and the both end portions, the transparent electrically conductive film at the central portion heats to a degree equal to or higher than that at the both end portions. Therefore, though the central portion of the transparent panel is air-cooled stronger than the both end portions and the exhalation impinges on the central portion when the shield panel is used, a defogging effect is effective.

In a preferred shield panel according to the present invention, a space is formed between the pair of transparent panels, and the transparent electrically conductive film is provided on the inner transparent panel. Therefore, the inner side transparent panel is heated by the transparent electrically conductive film, and the space between the pair of transparent panels functions as a heat insulating layer toward the inner transparent panel. Thus, even if a power source voltage is not high, the inner transparent panel is effectively heated, and a defogging effect is effective.

In a preferred shield panel according to the present invention, since a thickness of the metal foil is 10 $\mu$m or greater, the resistance of the electrode is low, but since the thickness of the metal foil is 100 $\mu$m or smaller, the flexibility of the electrode is high, and the electrode can be easily mounted to a transparent electrically conductive film having a three-dimensional curved surface. Therefore, the manufacturing cost is low.

In a preferred shield panel according to the present invention, the metal foil is a copper foil, and the copper has a low resistance. Therefore, even if the terminal for the electrode and the end portion of the electrode are separated from each other, the resistance of the electrode is low, and potential drop is less prone to be caused in the electrode, and a voltage applied between the pair of electrodes is effectively applied to the transparent electrically conductive film of the transparent panel. Therefore, even if a power source voltage is not high, the transparent panel is further effectively heated, and a defogging effect is further effective.

In a further preferred shield panel according to the present invention, since a thickness of the conductive adhesive layer is 10 $\mu$m or greater, the metal foil is reliably adhered to the transparent electrically conductive film, and the electrodes are less prone to be peeled off from the transparent electrically conductive film. Further, since the thickness of the conductive adhesive layer is 50 $\mu$m or smaller, the heat is easily transmitted between the transparent electrically conductive film and the metal foil, and the heat can be easily transmitted between regions of the transparent electrically conductive film through the metal foil. Therefore, even if a current flows through the transparent electrically conductive film unevenly due to non-uniform composition in the conductive adhesive layer, the transparent electrically conductive film and the conductive adhesive layer are prevented from local heating, and the transparent electrically conductive film and the conductive adhesive layer are less prone to be deteriorated. Therefore, the reliability is high and its life is long.

In a helmet according to the present invention, a pair of electrodes for a transparent electrically conductive film provided in a shield panel have metal foils. Each of the metal foils is a homogeneous continuous phase made of metal only, and thus the resistance is low. Further, the metal foils extend along the transparent electrically conductive film while electrically connected to the transparent electrically conductive film. For these reasons, even if a terminal for the electrode and an end portion of the electrode are separated from each other, the resistance of the electrode is low, and potential drop is not caused almost at all in the electrode. As a result, since a voltage applied between the pair of electrodes is effectively applied to the transparent electrically conductive film of the shield panel, even if a power source voltage is not high, the shield panel is effectively heated, and a defogging effect of the shield panel is effective. Further, since the terminals for the electrodes need not be located at central portions of the electrodes, a degree of freedom in design of the shield panel is high.

In a preferred helmet according to the present invention, there is provided with a mask which, by covering a nose and a mouth of a wearer, forms a space in communication with an outside in a state in which the space is isolated from a space facing an inner surface of the shield panel. For this reason, exhalation of the wearer is discharged to the outside and does not impinge on the shield panel. Therefore, in cooperation with circumstances that even if the power source voltage is not high the shield panel is effectively heated, the defogging effect of the shield panel is further effective.

In a preferred helmet according to the present invention, there is provided with an exhalation guide plate which is opposed to the nose of the wearer for guiding exhalation of the wearer to an outside. For this reason, exhalation of the wearer is easily discharged to the outside and does not easily impinge on the shield panel. Therefore, in cooperation with circumstances that even if the power source voltage is not high the shield panel is effectively heated, the defogging effect of the shield panel is further effective.

DETAILED DESCRIPTION OF THE PREFERRED EMBODIMENTS

Figure 1:
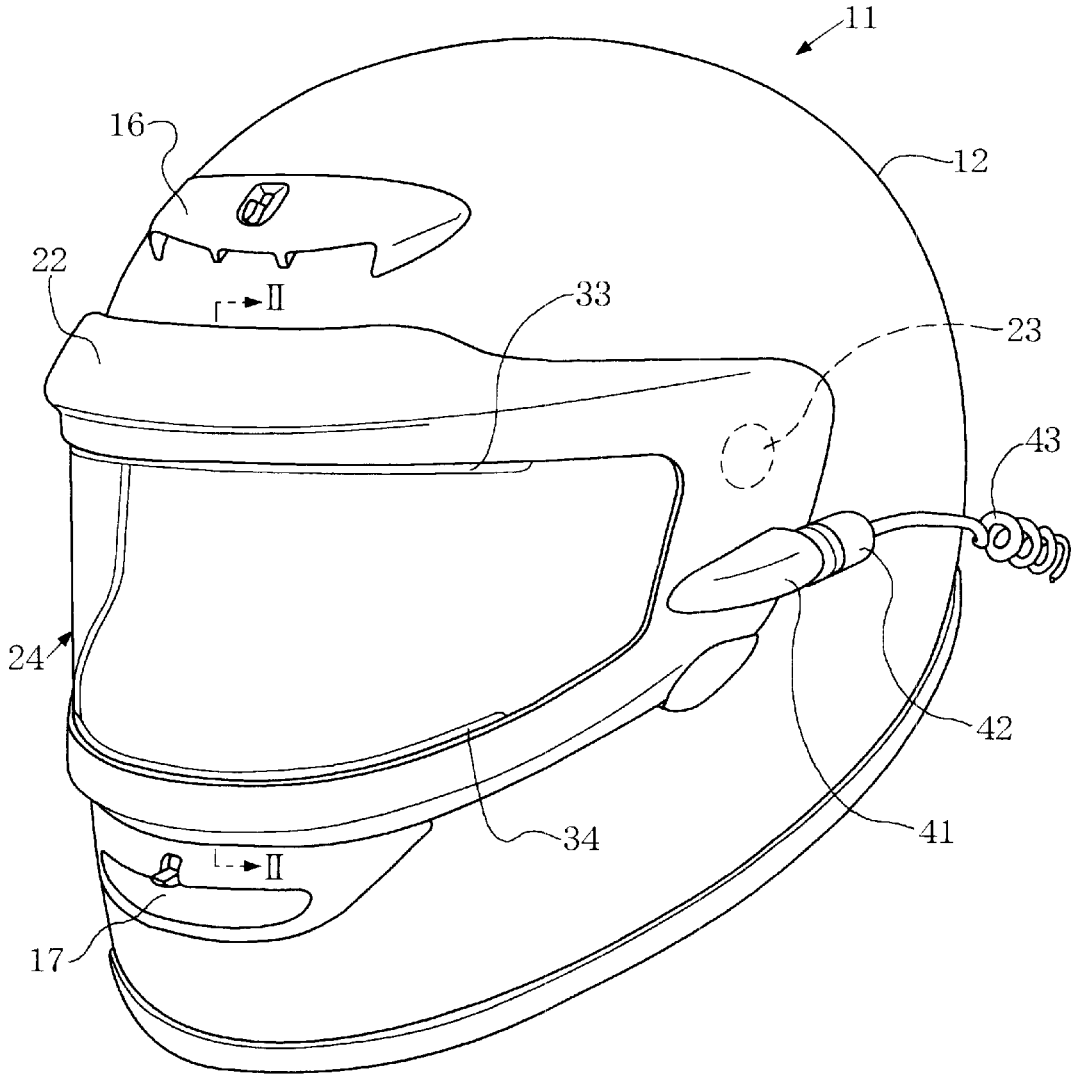
FIG. 1 is a perspective view of a helmet of the first embodiment of the present invention.
Figure 2:
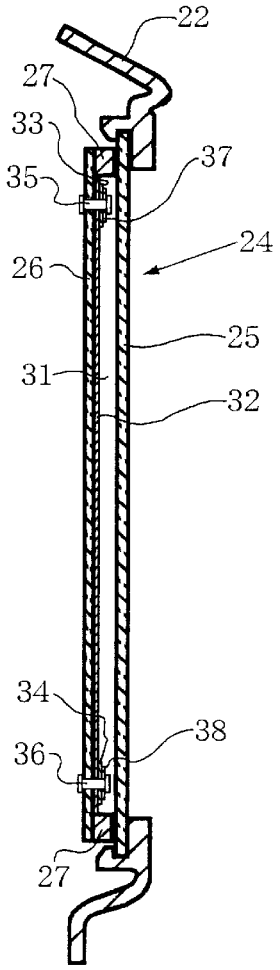
FIG. 2 is a sectional view taken along a II—II line in FIG. 1.
Figure 3:
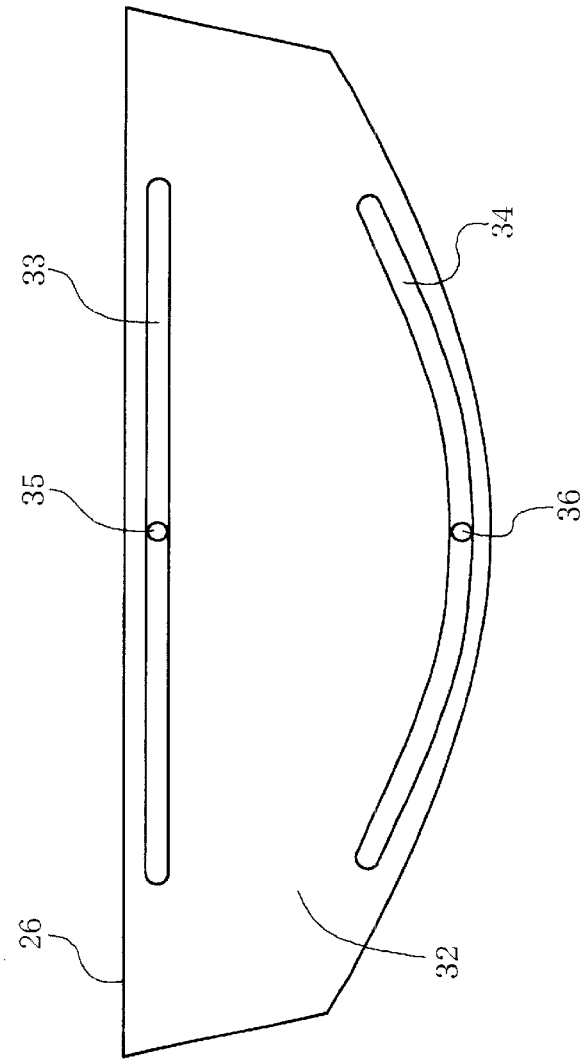
FIG. 3 is a front view of a flattened inside transparent panel of a shield panel of the first embodiment.

First to fourth embodiments of the present invention applied to a helmet having a shield panel will be explained with reference to FIGS. 1 to 8. FIGS. 1 to 3 show the first embodiment. A body 12 of a helmet 11 of the first embodiment is comprised of a hard plastic shell 13 (FIGS. 7 and 8), and a polystyrene foam cushioning liner 14 (FIGS. 7 and 8) fitted inside the shell 13.

The body 12 is provided at its portions corresponding to a front of a head and a mouth of a wearer 15 (FIG. 7 and 8) with an upper air intake opening 16 and a lower air intake opening 17, respectively. The body 12 is provided at its portion corresponding to a back of the head of the wearer 15 with an air discharge opening (not shown). The body 12 is provided at its front surface with an opening 21 (FIG. 7 and 8) through which the wearer 15 sees an outside. A shield frame 22 is mounted to the front surface of the body 12 by means of a pair of left and right pivots 23.

Figure 7:
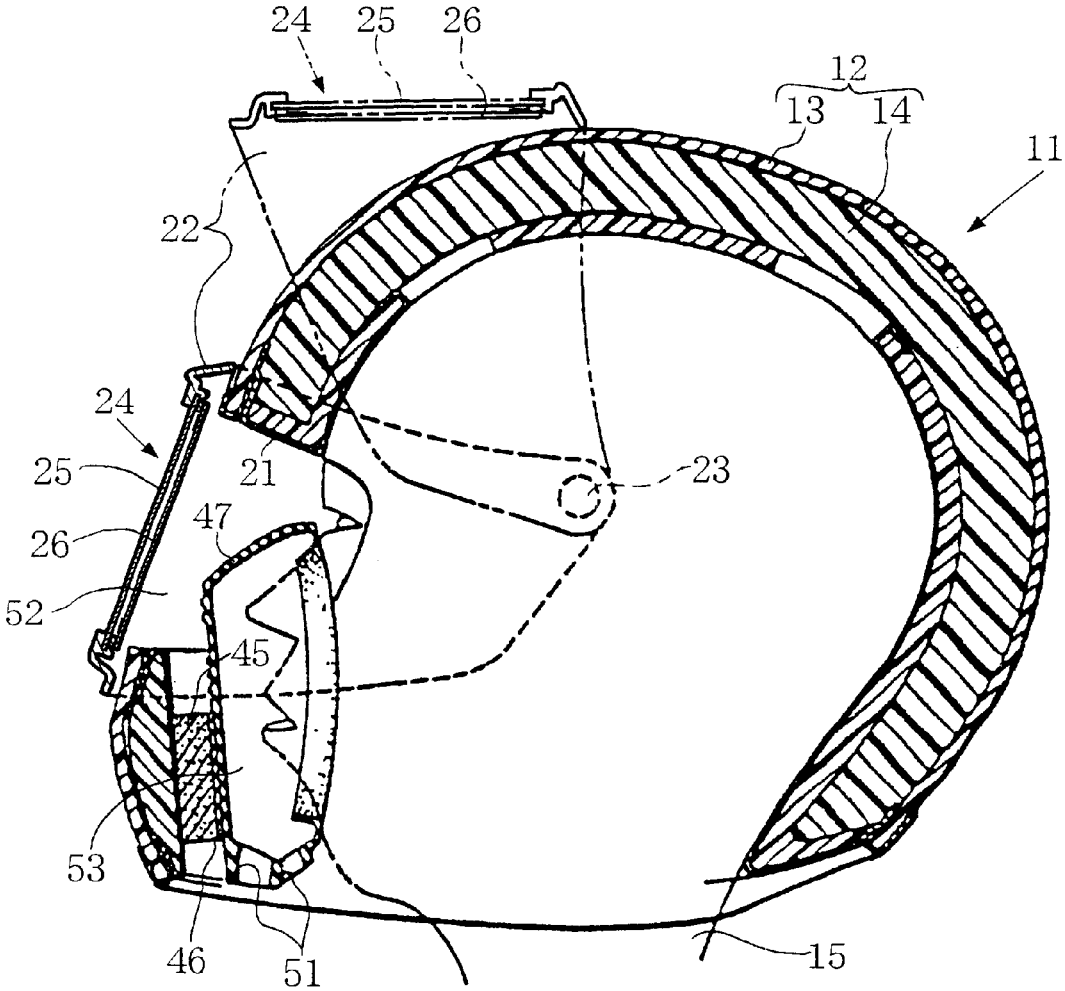
FIG. 7 is a sectional view of a helmet of the third embodiment of the present invention.
Figure 8:
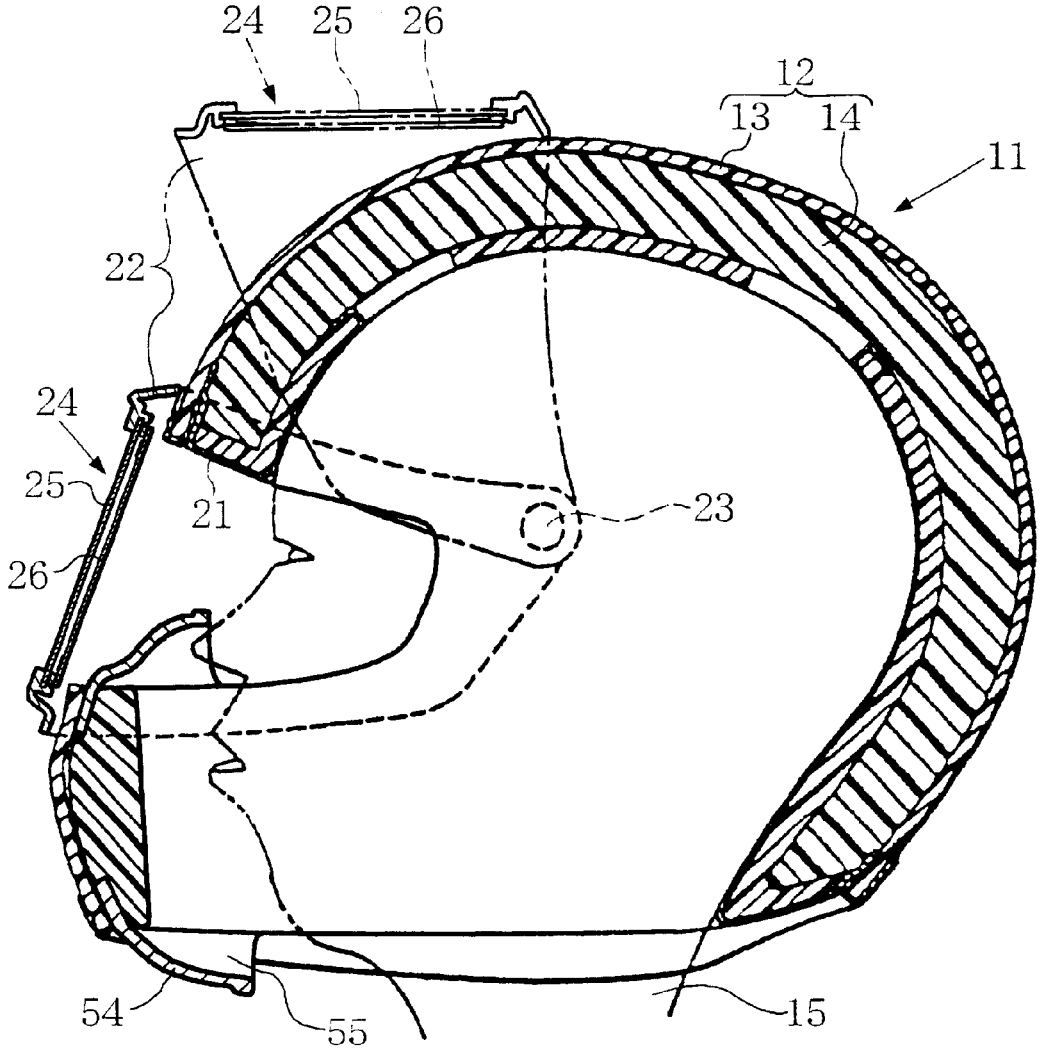
FIG. 8 is a sectional view of a helmet of the fourth embodiment of the invention.

A shield panel 24 is fitted to the shield frame 22 such that the shield frame 22 can rotate around the pivots 23 between a position where the shield panel 24 covers the opening 21 and a position where the shield panel 24 opens the opening 21 (FIGS. 7 and 8). The shield frame 22 is opaque and reinforces the shield panel 24. The shield panel 24 comprises a pair of outside and inside transparent panels 25 and 26 made of polycarbonate resin. A spacer 27 is interposed between peripheries of the transparent panels 25 and 26, and a space 31 is formed between the transparent panels 25 and 26 by means of the spacer 27.

The inside transparent panel 26 is provided at its substantially entire surface facing the space 31 with a transparent electrically conductive film 32. A pair of electrodes 33 and 34 are mounted on the transparent electrically conductive film 32 at locations corresponding to upper and lower end portions of the transparent panel 26. The transparent electrically conductive film 32 is made of ITO thin film, and is provided on the transparent panel 26 by reactive sputtering using indium and tin as a target and using oxygen gas as reactive gas, ion plating using indium and tin as vaporization source and oxygen gas as active atmosphere, or the like.

A thickness of the transparent electrically conductive film 32 increases from the both end portions in a lateral direction of the transparent panel 26 toward the central portion. A ratio of the thickness of the transparent electrically conductive film 32 at the central portion to the thickness of the transparent electrically conductive film 32 at the both end portions is equal to or greater than a ratio of a distance between the electrodes 33 and 34 at the central portion to a distance between the electrodes 33 and 34 at the both end portions. Therefore, even if a width of the transparent panel 26 is wider at the central portion than that at the both end portions so as to secure the visibility of the wearer 15, a resistance of the transparent electrically conductive film 32 at the central portion is equal to or smaller than that of the transparent electrically conductive film 32 at the both end portions.

In order to form the transparent electrically conductive film 32 having such a thickness distribution, if reactive sputtering is employed, a plasma state is concentrated on the central portion of the transparent panel 26 as compared with the both end portions, or a distance between the transparent panel 26 and the target is made shorter at the central portion than at the both end portions. If ion plating is employed, a vaporization amount of metal is increased at the central portion of the transparent panel 26 as compared with at the both end portions, or a voltage applied to the transparent panel 26 is increased at the central portion as compared with at the both end portions.

A material of each of the electrodes 33 and 34 is a tape-like object in which a rolled copper foil having a thickness of 40 $\mu$m, a conductive adhesive layer with an acryl or the like base having a thickness of 30 $\mu$m, and a parting sheet having a thickness of 120 $\mu$m are laminated on one another. Each of the electrodes 33 and 34 is formed in such a manner that a portion of the tape-like object having a shape shown in FIG. 3 is cut out, and the parting sheet is peeled off from this portion. Each of the electrodes 33 and 34 is adhered to the transparent electrically conductive film 32 by means of the conductive adhesive layer exposed by peeling off the parting sheet. Therefore, the copper foils of the electrodes 33 and 34 extend along the transparent electrically conductive film 32 while electrically connected to the transparent electrically conductive film 32 through the conductive adhesive layer.

Although a surface of the transparent electrically conductive film 32 onto which the electrodes 33 and 34 are adhered is a three-dimensional curved surface, since the thickness of the copper foil is as thin as 40 $\mu$m, flexibility of each of the electrodes 33 and 34 is high, and the electrodes 33 and 34 can be easily adhered onto the three-dimensional curved surface. Instead of the copper foils, other metal foils may be used for the electrodes 33 and 34. In order to secure the flexibility of the electrodes 33 and 34, it is preferable that a thickness of the metal foil is 100 $\mu$m or less. However, if the thickness of the metal foil is too thin, the resistance of the electrodes 33 and 34 is increased, it is preferable that the thickness of the metal foil is 10 $\mu$m or greater.

In order to make the electrodes 33 and 34 less prone to be peeled off from the transparent electrically conductive film 32 by means of reliably adhering the electrodes 33 and 34 to the transparent electrically conductive film 32, it is preferable that a thickness of the conductive adhesive layer is 10 $\mu$m or greater. However, even if a current flows through the transparent electrically conductive film 32 unevenly due to non-uniform composition in the conductive adhesive layer, in order to make the transparent electrically conductive film 32 and the conductive adhesive layer less prone to be deteriorated by means of preventing the transparent electrically conductive film 32 and the conductive adhesive layer from local heating, it is necessary to facilitate the heat transmission between the transparent electrically conductive film 32 and the copper foil so that the heat can be easily transmitted between regions of the transparent electrically conductive film 32 through the copper foil. For that purpose, it is preferable that a thickness of the conductive adhesive layer is 50 μm or less.

Terminals 35 and 36 are secured to central portions of the electrodes 33 and 34, respectively, such that the terminals 35 and 36 pass through the transparent panel 26, the transparent electrically conductive film 32, the electrodes 33 and 34 and one end portions of conductive wires 37 and 38. The conductive wires 37 and 38 are connected to the electrodes 33 and 34, respectively. A plug-in socket 41 is adhered to an outer surface of a left end portion of the shield frame 22. The other end portions of the conductive wires 37 and 38 are connected to the plug-in socket 41.

A coaxial pin (not shown) of a plug 42 is inserted in the plug-in socket 41, and a power cord 43 is connected to the plug 42. In order to perform the defogging function using electric heating on the shield panel 24 of the helmet 11 having the above-described structure, the pin of the plug 42 is inserted into the plug-in socket 41, and the power cord 43 of the plug 42 is connected to a power source of the autobicycle or the like.

As a result, a voltage of the power source is applied to the transparent electrically conductive film 32 through the conductive wires 37 and 38, the terminals 35 and 36, the electrodes 33 and 34 and the like, and a current flows through the transparent electrically conductive film 32 to make the transparent electrically conductive film 32 heat, and the transparent panel 26 is heated by the transparent electrically conductive film 32. Therefore, when the shield panel 24 is air-cooled by running of the autobicycle or the like, even if water vapor in exhalation of the wearer 15 impinges on the transparent panel 26, condensation or freezing is not generated on the transparent panel 26.

The central portion in the lateral direction of the shield panel 24 is air-cooled strongly by running of the autobicycle or the like, but the both end portions in the lateral direction are air-cooled weakly as compared with the central portion, and exhalation of the wearer 15 impinges mainly on the central portion in the lateral direction of the transparent panel 26. However, since the resistance of the transparent electrically conductive film 32 at the central portion is equal to or smaller than that of the transparent electrically conductive film 32 at the both end portions as described above, the transparent electrically conductive film 32 at the central portion heats to a degree equal to or higher than the transparent electrically conductive film 32 at the both end portions. Further, as shown in FIGS. 1 and 3, even if the electrodes 33 and 34 for applying a voltage to the transparent electrically conductive film 32 to flow a current is not extended till the both end portions in the lateral direction of the transparent panel 26, any obstruction does not occur.

Figure 4:
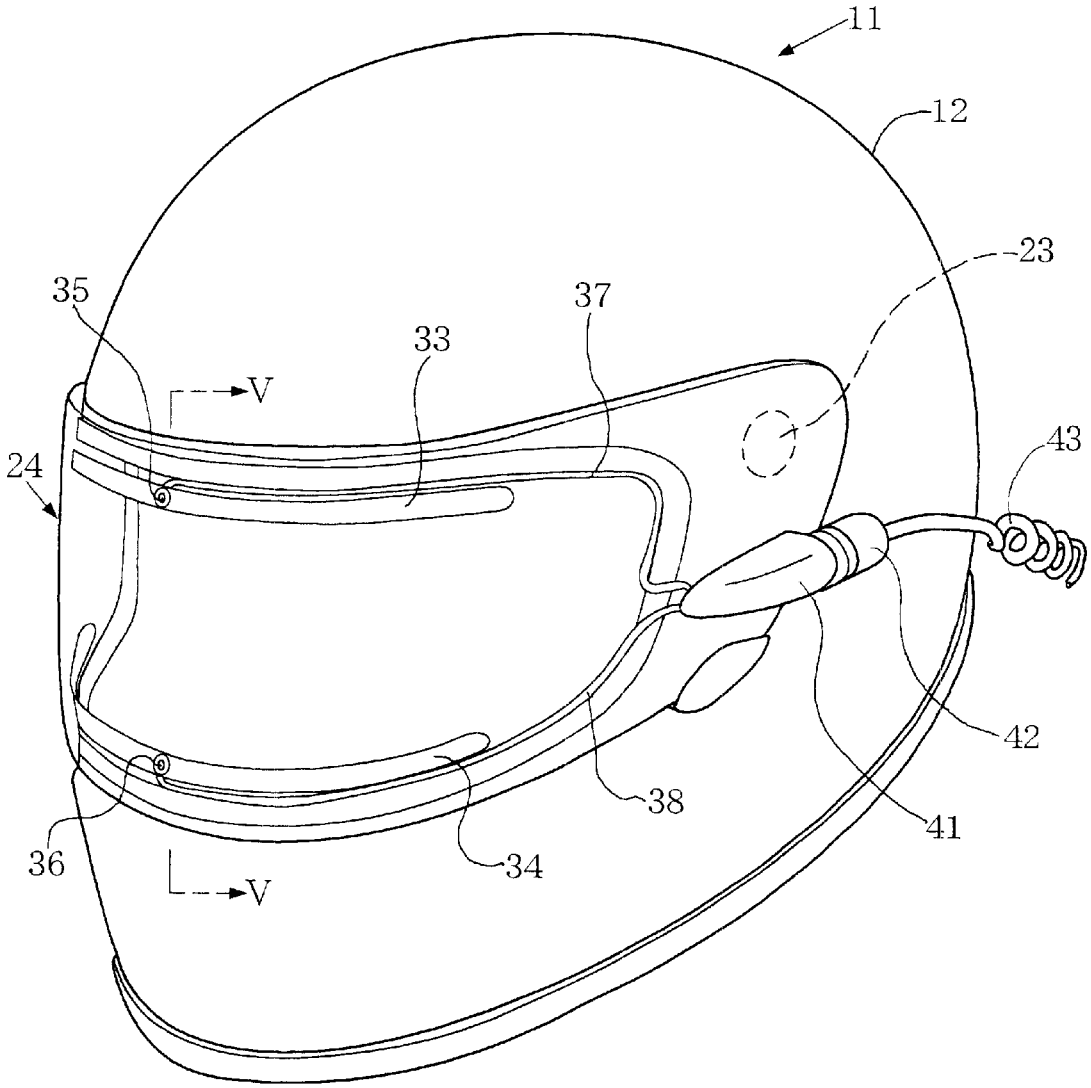
FIG. 4 is a perspective view of a helmet of the second embodiment of the invention.
Figure 5:
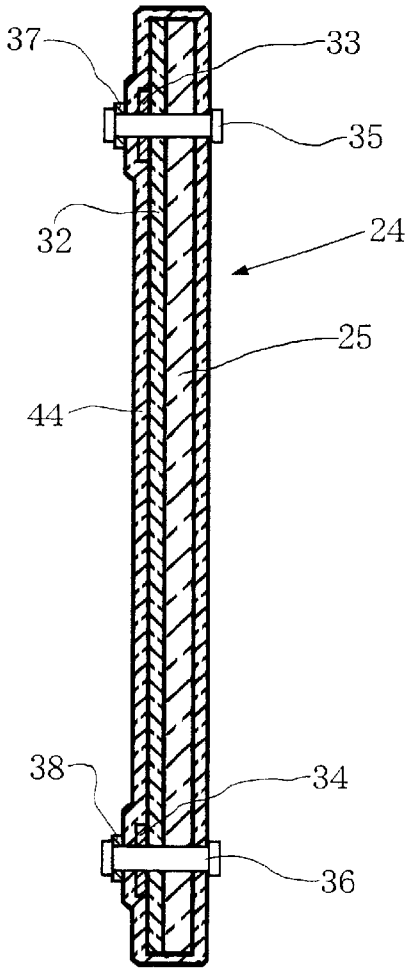
FIG. 5 is a sectional view taken along a V—V line in FIG. 4.
Figure 6:
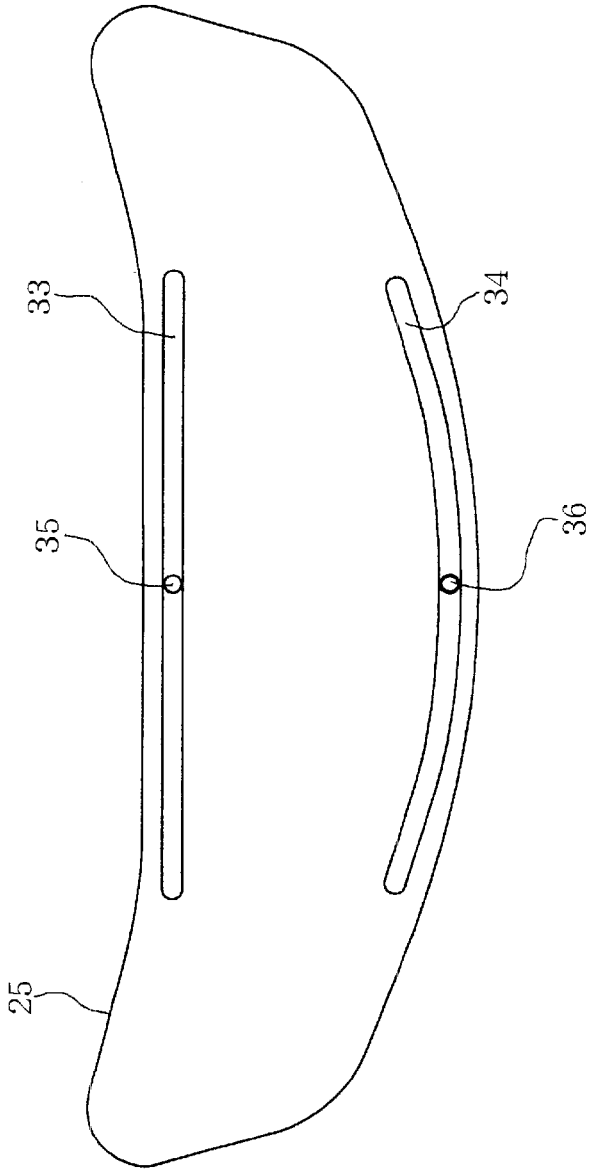
FIG. 6 is a front view of a flattened shield panel of the second embodiment.

FIGS. 4 to 6 show the second embodiment. The helmet 11 of the second embodiment does not have the shield frame 22, and the shield panel 24 is directly mounted to the body 12 by means of the pivots 23. The shield panel 24 comprises the single transparent panel 25 only. The transparent panel 25 is provided at its substantially entire inner surface with the transparent electrically conductive film 32.

The plug-in socket 41 is adhered to an outer surface of a left end portion of the shield panel 24. Except the above structure, the helmet 11 of the second embodiment has substantially the same structure as that of the helmet 11 of the first embodiment shown in FIGS. 1 to 3. Although the upper air intake opening 16 and the lower air intake opening 17 are not shown in FIG. 4, the helmet 11 of the second embodiment may be also provided with the upper air intake opening 16 and the lower air intake opening 17.

FIG. 7 shows the third embodiment. In the helmet 11 of the third embodiment, a urethane foam cushion 45 is mounted to a portion of an inner surface of the body 12 corresponding to a mouth and a chin of the wearer 15. A mask 47 is detachably mounted to the cushion 45 by means of a mounting tool 46 such as a hook-and-loop fastener. The mask 47 is made of resilient material such as rubber so that the mask 47 comes into soft contact with the wearer 15 such as to cover a nose and the mouth of the wearer 15. The mask 47 is provided at its lower end portion with an opening 51.

Except the above structure, the helmet 11 of the third embodiment has substantially the same structure as that of the helmet 11 of the first embodiment shown in FIGS. 1 to 3. In the helmet 11 of the third embodiment, the mask 47 forms a space 53 which is in communication with the outside through the opening 51 in a state in which the space 53 is isolated from a space 52 facing the inner surface of the shield panel 24. Therefore, exhalation of the wearer 15 is discharged to the outside through the opening 51 and thus the exhalation does not impinge on the shield panel 24.

FIG. 8 shows the fourth embodiment. In the helmet 11 of the fourth embodiment, a soft plastic exhalation guide plate 54 and a soft plastic chin cover 55 are detachably mounted to the inner side of the body 12. The exhalation guide plate 54 is opposed to the nose of the wearer 15, the chin cover 55 is opposed to the chin of the wearer 15, and a gap 56 is formed between the chin cover 55 and the chin of the wearer 15. Except the above structure, the helmet 11 of the fourth embodiment has substantially the same structure as that of the helmet 11 of the first embodiment shown in FIGS. 1 to 3.

In the helmet 11 of the fourth embodiment, exhalation coming out from the nose of the wearer 15 impinges on the exhalation guide plate 54 and is less prone to impinge on the shield panel 24. Exhalation coming out from the mouth of the wearer 15 is hindered by the exhalation guide plate 54 and is also less prone to impinge on the shield panel 24. These exhalations are discharged to the outside through the gap 56. Further, during running of the autobicycle or the like, since outside air is less prone to be drawn into the helmet 11 because of the chin cover 55, exhalation of the wearer 15 is restrained from impinging on the shield panel 24 together with the air drawn into the helmet 11.

Although the terminals 35 and 36 are located at central portions of the electrodes 33 and 34 in each of the first to fourth embodiment, the resistance of each of the electrodes 33 and 34 is low, and potential drop is not caused almost at all in the electrodes 33 and 34, the terminals 35 and 36 need not be located at the central portions of the electrodes 33 and 34. For example, the terminals 35 and 36 may be mounted to the left end portions of the electrodes 33 and 34 closer to the plug-in socket 41. In this case, the conductive wires 37 and 38 can be shortened.

Further, the ratio of the thickness of the transparent electrically conductive film 32 at the central portion in the lateral direction of the transparent panel 26 to the thickness of the transparent electrically conductive film 32 at the both end portions is equal to or greater than the ratio of the distance between the electrodes 33 and 34 at the central portion to the distance between the electrodes 33 and 34 at the both end portions. However, even if the ratio of the thickness of the transparent electrically conductive film 32 is 1.1 or greater irrespective of the distance between the electrodes 33 and 34, the heating value of the transparent electrically conductive film 32 at the central portion is secured as compared with a case in which the ratio is less than 1.1. Although the transparent electrically conductive film 32 is the ITO thin film, the transparent electrically conductive film 32 may be made of a thin film such as gold.

The transparent electrically conductive film 32 is provided on only one surface of the transparent panel 25 or the transparent panel 26, the transparent electrically conductive film 32 may be provided on both surfaces of the transparent panel 25 or the transparent panel 26 or the entire surfaces of the transparent panels 25 and 26. Although the present invention is applied to the helmet having the shield panel in each of the first to fourth embodiments, the invention can also be applied to a shield panel detachably mounted, by means of a band or the like, to a helmet having no shield panel.

What is claimed is:

1. A helmet having defogging capability comprising:

a body having an opening opposite a wearer's eyes;

at least one transparent panel connected to said body, said panel extending laterally over said opening and having upper and lower end portions, side end portions and a central portion;

a transparent electrically conductive film mounted to at least one surface of said transparent panel and extending laterally along said panel;

a first electrode mounted to said electrically conductive film by electrically conductive adhesive near said upper end portion of said panel and extending laterally across said panel;

a second electrode mounted to said electrically conductive film by electrically conductive adhesive, said second electrode being spaced from said first electrode and extending laterally across said panel; and said transparent electrically conductive film being of greater thickness at said panel central portion than at said panel side end portions, there being a ratio of the thickness of electrically conductive film at said panel central portion to the thickness of electrically conductive film at said panel side end portions of greater than one to one.

2. A helmet as claimed in claim 1 wherein:

the spacing between said first electrode and said second electrode varies.

3. A helmet as claimed in claim 2 wherein:

said first and said second electrodes include metal foil having a thickness of between 10 and 100 $\mu$m.

4. A helmet as claimed in claim 3 wherein:

said conductive adhesive has a thickness of between 10 and 50 $\mu$m.

5. A helmet having defogging capability comprising:

a body having an opening opposite a wearer's eyes;

at least one transparent panel connected to said body, said panel extending laterally over said opening and having upper and lower end portions, side end portions and a central portion;

a transparent electrically conductive film mounted to at least one surface of said transparent panel and extending laterally along said panel;

a first electrode mounted to said electrically conductive film by electrically conductive adhesive near said upper end portion of said panel and extending generally laterally across said panel;

a second electrode mounted to said electrically conductive film by electrically conductive adhesive near said lower end portion of said panel and extending generally laterally across said panel; and said transparent electrically conductive film being of greater thickness at said panel central portion than at said panel side end portions, wherein a ratio of the thickness of electrically conductive film at said central portion to the thickness of electrically conductive film at said side end portions is equal to or greater than a ratio of distances between said first and said second electrodes at said panel central portion to the distances between said first and said second electrodes at said panel side end portions.

6. A helmet as claimed in claim 5 wherein:

the spacing between said first electrode and said second electrode varies, there being greater distances between said first and said second electrodes at said panel central portion than the distances between said first and said second electrodes at said panel side end portions.

7. A helmet as claimed in claim 5 wherein:

said first and said second electrodes include low resistance metal foil.

8. A helmet as claimed in claim 7 wherein:

said metal foil has a thickness of between 10 and 100 $\mu$m.

9. A helmet as claimed in claim 8 wherein:

said conductive adhesive has a thickness of between 10 and 50 $\mu$m.

10. A helmet as claimed in claim 9 wherein:

said transparent panel is curved.

11. A helmet as claimed in claim 10 wherein:

said metal foil comprises copper.

12. A helmet as claimed in claim 5 wherein:

said transparent panel includes inner and outer panels separated by a space; and said electrically conductive film is mounted to said inner panel.

13. A helmet as claimed in claim 5 including:

means for diverting a wearer's exhalation from said transparent panel.

14. A helmet as claimed in claim 13 wherein:

said diverting means is a mask for covering a nose and a mouth of a wearer of said helmet, said mask forming a space in communication with air outside of said helmet; and wherein said space is separated from another space between a wearer and said transparent panel.

15. A helmet as claimed in claim 14 wherein:

said first and said second electrodes include metal foil having a thickness of between 10 and 100 $\mu$m.

16. A helmet as claimed in claim 15 wherein:

said conductive adhesive has a thickness of between 10 and 50 $\mu$m.

17. A helmet as claimed in claim 13 wherein:

said diverting means is an exhalation guide plate positioned adjacent a nose of a wearer of said helmet for guiding exhalation of the wearer to air outside of said helmet.

18. A helmet as claimed in claim 17 wherein:

said first and said second electrodes include low resistance metal foil.

19. A helmet as claimed in claim 18 wherein:

said metal foil has a thickness of between 10 and 100 $\mu$m.

20. A helmet as claimed in claim 19 wherein:

said conductive adhesive has a thickness of between 10 and 50 $\mu$m.

21. A helmet as claimed in claim 20 wherein:

said transparent panel is curved.

* * * * *